US006581555B1

(12) United States Patent
Abele et al.

(10) Patent No.: US 6,581,555 B1
(45) Date of Patent: Jun. 24, 2003

(54) METHOD AND DEVICE FOR OPENING AND CLOSING A VALVE OF AN INTERNAL COMBUSTION ENGINE

(75) Inventors: Marcus Abele, Marxzell-Burbach (DE); Thomas Glas, Remshalden (DE); Martin Lechner, Stuttgart (DE); Christoph Steinmetz, Ludwigsburg (DE)

(73) Assignee: Mahle Ventiltrieb GmbH, Suttgart (DE)

( * ) Notice: Subject to any disclaimer, the term of this patent is extended or adjusted under 35 U.S.C. 154(b) by 0 days.

(21) Appl. No.: 10/018,496

(22) PCT Filed: Apr. 5, 2000

(86) PCT No.: PCT/EP00/02996

§ 371 (c)(1),
(2), (4) Date: Oct. 29, 2001

(87) PCT Pub. No.: WO00/66883

PCT Pub. Date: Nov. 9, 2000

(30) Foreign Application Priority Data

Apr. 30, 1999 (DE) ..... 199 19 734

(51) Int. Cl.[7] ..... F01L 9/04

(52) U.S. Cl. ..... 123/90.11; 251/129.01; 251/129.15; 251/129.16

(58) Field of Search ..... 123/90.11

(56) References Cited

U.S. PATENT DOCUMENTS

| | | | | |
|---|---|---|---|---|
| 4,375,793 A | | 3/1983 | Seilly et al. | 123/90.11 |
| 5,131,624 A | * | 7/1992 | Kreuter et al. | 251/129.18 |
| 5,645,019 A | * | 7/1997 | Liang et al. | 123/90.11 |
| 5,730,091 A | | 3/1998 | Diehl et al. | 123/90.11 |
| 5,765,513 A | * | 6/1998 | Diehl et al. | 123/90.11 |
| 5,813,653 A | * | 9/1998 | Esch et al. | 251/129.1 |

FOREIGN PATENT DOCUMENTS

| | | |
|---|---|---|
| DE | 39 11 496 | 10/1990 |
| DE | 197 23 405 | 12/1998 |
| DE | 197 33 186 | 2/1999 |

* cited by examiner

*Primary Examiner*—Thomas Denion
*Assistant Examiner*—Ching Chang
(74) *Attorney, Agent, or Firm*—Collard & Roe, P.C.

(57) ABSTRACT

The invention relates to a method and to a device for opening and closing a valve of an internal combustion engine. The aim of the invention is to reduce the energy required for opening and closing a valve of an internal combustion engine, especially one that is provided with an electromagnetic valve control. To this end, the kinetic energy of the valve is transferred to a mass and temporarily stored in a mass.

12 Claims, 2 Drawing Sheets

METHOD AND DEVICE FOR OPENING AND CLOSING A VALVE OF AN INTERNAL COMBUSTION ENGINE

CROSS REFERENCE TO RELATED APPLICATIONS

Applicants claim priority under 35 U.S.C. §119 of German Application No. 199 19 734.2 filed Apr. 30, 1999. Applicants also claim priority under 35 U.S.C. §120 of PCT/EP00/02996 filed Apr. 5, 2000. The international application under PCT article 21(2) was not published in English.

The invention relates to a method and to a device for opening and closing a valve of an internal combustion engine.

Known are the camshaft-controlled valve actuation, the electromagnetic control and the hydraulic valve control. The invention is principally based on the electromagnetic valve control (EMVC). However, it can be applied in connection with other valve controls as well, for example such as the hydraulic or the pneumatic valve control.

The EMVC has been structured until now in the form of an oscillator comprising one mass, whereby an armature is oscillating back and forth between two magnetic coils. The armature is connected with the valve. In the currentless condition, the armature is located in about the center between the two magnetic coils. Because of the large gap in the idle position and the poor efficiency connected therewith, a relatively high expenditure of energy is required during acceleration, which per se makes the feasibility of the electromagnetic valve control questionable in series applications, to begin with.

For reducing the energy requirement and in particular for the purpose of minimizing the so-called armature thumping and thus the noise, DE 197 23 405 A1 discloses a method by which a defined rate of impact of the armature can be adjusted when the valve is closing.

A drawback has to be seen in the fact that valve niches have to be worked into the piston in order to safely prevent the valve from coming into contact with the piston, or that the wall of the combustion chamber has to be recessed in the cylinder head. In terms of combustion technology, such measures represent a negative influence on the combustion chamber.

Therefore, the invention is dealing with the problem of reducing the use of energy in connection with electromagnetic or hydraulic valve controls and to avoid any negative influence on the combustion process exerted on the cylinder head by valve niches or recessed walls of the combustion chamber.

SUMMARY OF THE INVENTION

Said problem is solved in connection with methods of the type specified above by the characterizing features specified in claim 1. In conjunction with devices of the type specified above, the problem is solved by the characterizing features specified in claim 4 or 5. Advantageous further developments of the invention are the objects of the dependent claims.

The basic idea of the invention is to transmit the kinetic energy, and possibly of a mass component connected with the valve, such energy being contained in the valve at the end of the closing process, to a body of mass, and to store such energy there intermediately, so that this energy is available for the next opening stroke of the valve. In such a process, the pulse or mechanical pulse can be transmitted in each case directly between the bodies of mass, or passed on via at least one intermediate member, whereby the intermediate member is either arranged stationary to the greatest possible extent, or connected with one of the two masses. If the body of mass is to be retained, for example, by a magnet, the energy is intermediately stored in a spring, as a rule that exerts a resetting force on the body of mass.

Physically speaking, the known EMVC represents a pendulum comprising one mass, whereas the invention can be described as a pendulum comprising two masses with energy transmission.

The known one-mass oscillation of the EMVC is divided in this connection in two semi-oscillations with two masses. At the end of each semi-oscillation, the kinetic energy is transferred to the second oscillating mass by a shock pulse. Through suitable coordination, for example via the spring rate, the basic duration of the oscillation of the valve is adjusted at the ratio of "three cycles closed" to "one cycle opened".

Therefore, a variation of the oscillation times can be realized by adjusting the initial tension of the spring and/or the stiffness of the spring, on the one hand, and with the help of known means such as magnetic retention in the end positions on the other.

The following advantages are obtained as compared to the known EMVC:

- The valve remains closed without external energy feed because the energetic zero-position is present in the closed condition. If necessary, the valve can be pressed also into the valve seat by spring force.
- Undefined operating points are avoided because a clear idle position is available in the cycle of the valve movement.
- The swing-in takes place in a controlled manner; contact of the valve with the piston can be excluded. This means that the combustion chamber can be designed in an optimal manner, especially without valve niches.
- Due to the pulse-like transmission it is possible to realize very steep opening flanks, or very rapid opening of the valve is made possible.
- The valve opening duration can be varied without changing the initial tension of the spring.

BRIEF DESCRIPTION OF THE DRAWINGS

The invention is explained in the following with the help of an exemplified embodiment shown in the drawing, in which:

In FIG. 1, the system is shown in the idle condition.

DETAILED DESCRIPTION

Figure 1:
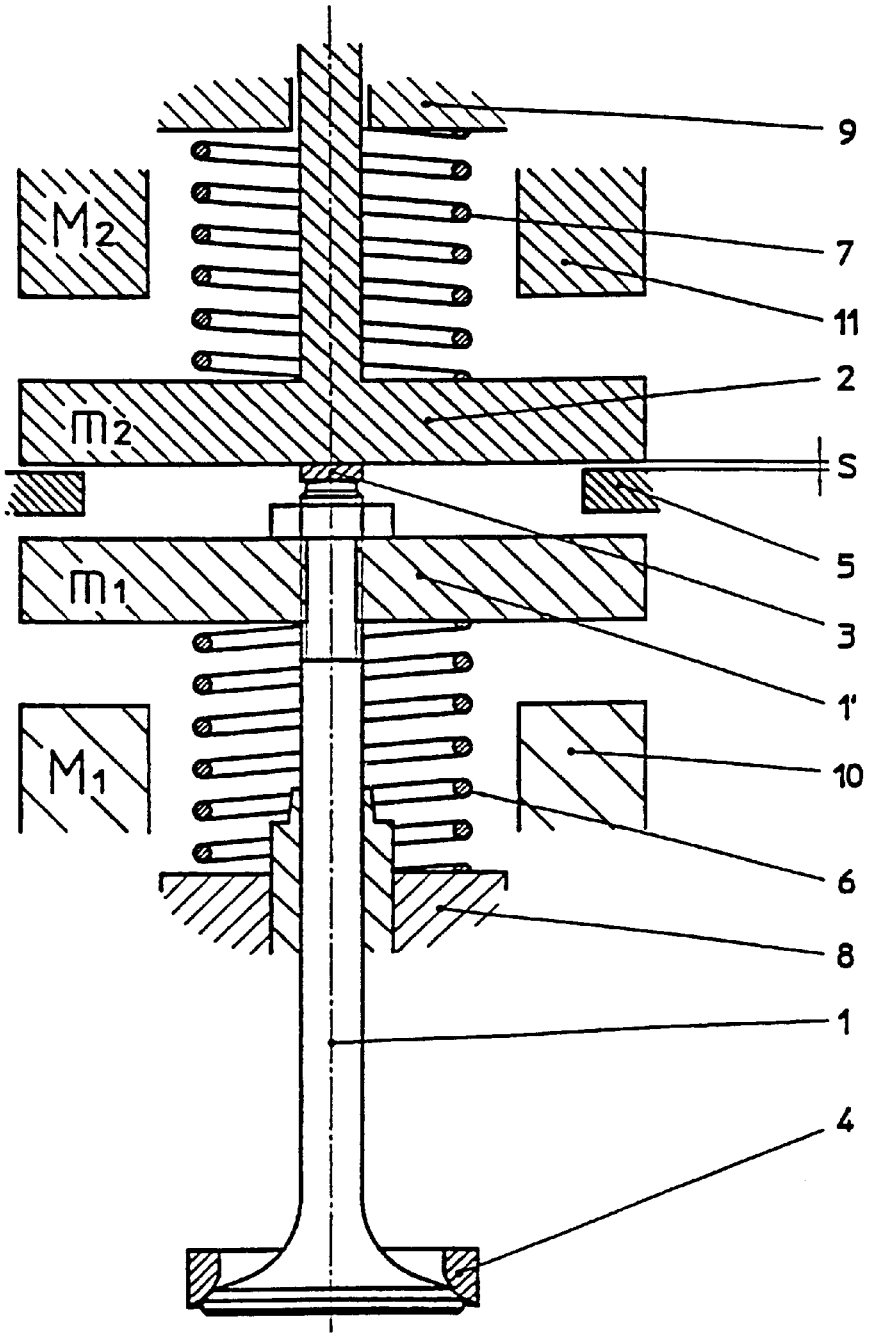
FIG. 1 shows a device as defined by the invention for actuating a valve in the idle position.

A valve 1 and a mass 1' connected with the valve by a thread, as well as a mass 2 are capable of exchanging their kinetic energy or their pulse via an intermediate member 3 that is connected with the mass 2 (m2) in a fixed manner.

For limiting the movement of the mass 1' or of the valve 1 connected with the mass 1', provision is made for a stop 5 for the valve seat ring 4 with the cylinder head not shown, and for the mass 2. The position of the stop 5 is fixed or adjustable in such a manner that the valve can be closed under all operating conditions. The initial tensional force of the spring 6 is adjusted with the help of the adjustable support 8 in such a way that it is greater than the force of the spring 7 with the support 9 in order to assure that the valve is safety closed in the idle position. The masses 1' (ml) and 2 (m2) are accelerated, delayed, and retained in the end positions by means of the electromagnets 10 (M1) and 11 (M2).

As compared to known electromagnetic actuators for valve controls, no connection exits between the valve 1 and the actuating member for the valve, thus the mass $m_2$; the two elements are separated from each other, with the separation being located as shown in FIG. 1 between the start of the thread of the valve and the intermediate member 3.

Figure 2:
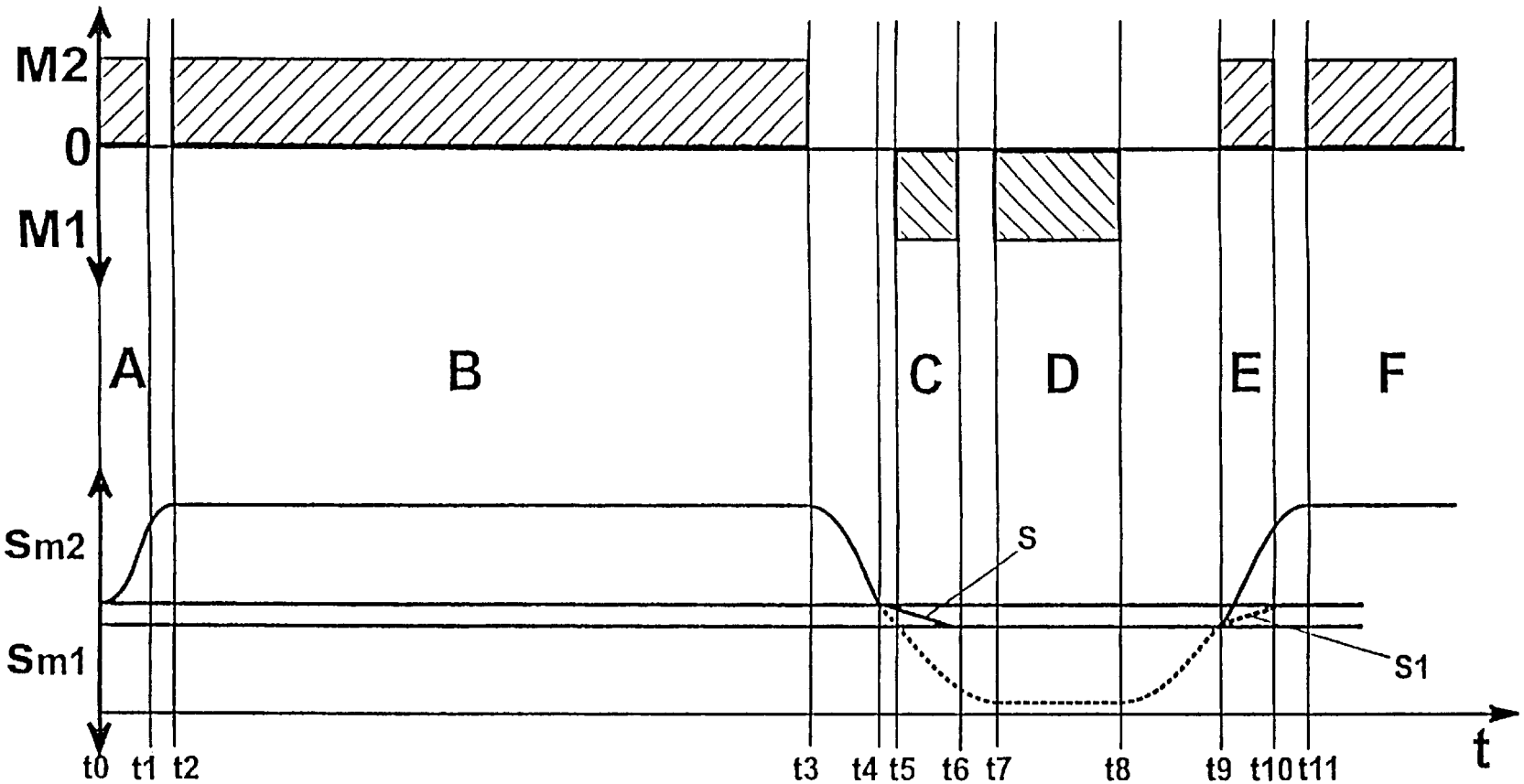
FIG. 2 shows a flow diagram of a method as defined by the invention.

FIG. 2 shows a possible sequence of the method as defined by the invention, which has to be read in association with FIG. 1.

Plotted above the time axis t in the upper area are the switch-on times of the electromagnets $M_1$ and $M_2$, and in the lower area the deflections $Sm_1$ and $Sm_2$ of the masses $m_1$ and $m_2$ caused by the electromagnets.

At the $t_0$, the magnet $M_2$ is supplied with current and moves the mass $m_2$ with acceleration until time $t_1$ against the force of the spring 7 in the direction of the retaining position (area A).

At time $t_1$, the delay of the mass $m_2$ starts, and then ends at $t_2$ when the mass $m_2$ has reached the retaining position. Starting at time $t_2$, the magnet $M_2$ retains the mass $m_2$ until time $t_3$ (area B).

At time $t_3$, the mass $m_2$ is released and, accelerated by the spring 7, starts the return movement until the transfer point of the energy from $m_2$ to $m_1$ at time $t_4$. After the energy has been transferred, the pulse of the mass $m_2$ is almost 0 and the mass $m_1$ has taken over the pulse of the mass $m_2$ to the greatest possible extent.

The mass $m_1$ accelerates starting at $t_4$ and is moved within the time span $t_5$, until $t_6$ (area C) in to the valve opening direction by supplying current to the magnet $M_1$. At the same time, the mass $m_2$ moves by means of spring force into the idle position on the stop 5, passing in the process through the idle path s. Said movement may takes place in a delayed manner with the help of a damping element.

The mass $m_1$ is retarded during the time span from $t_6$ until $t_7$.

The time during which the valve is completely opened (area D) is disposed between $t_7$ and $t_8$, during which time the magnet $M_1$ retains the valve in the open position.

At time $t_8$, $m_1$ is released, the valve closing movement starts, and the kinetic energy is transferred from $m_1$ to $m_2$ at time $t_9$.

The mass $m_2$ accelerates and is moved in the direction of the retaining position by supplying $M_2$ with current during the time span E, and fixed in the retaining position by supplying $M_2$ with current during the time span F.

At the same time, starting at $t_9$, the mass $m_1$ starts to move by the force of the spring 6 and moves into its idle position, in which the valve is closed, passing in the process through the idle path s.

The feed is current to the magnets $M_1$ and $M_2$ thus is interrupted in each case shortly before the deflected position of the associated masses has been reached (time spans $t_1$ until $t_2$, $t_6$ until $t_7$, and $t_{10}$ until $t_{11}$), in order to prevent the associated stops from being impacted excessively hard.

From $t_0$ until $t_4$, the valve rests against the valve seat; from $t_4$ until $t_{10}$, the valve is completely or partially opened.

The maximum consumption of electrical power of the electromagnets can be substantially reduced by the valve control as defined by the invention because within the range of large gaps between the magnet and the component attracted by the magnet, re-application of the kinetic energy saves a major portion of the electrical energy required otherwise.

What is claimed is:

1. A method for opening and closing a valve of an internal combustion engine, the engine having a first mass coupled to a valve, a second mass, said second mass being movably arranged, a stop disposed between the first mass and the second movably arranged mass, the method comprising the steps of:

a) transferring kinetic energy of the valve during a closing movement of the valve via a mechanical pulse, from the first mass to the second movably arranged mass;

b) storing in the second movably arranged mass said kinetic energy as potential energy;

c) transferring said potential energy in the second movably arranged mass back into kinetic energy which is then translated into the first mass and onto the valve;

d) moving said valve into an open position via the kinetic energy;

e) resting the second movably arranged mass against a stop, when the valve is in motion during said step of resting and wherein an electromagnet retains the valve in an open position.

2. A device for actuating a valve of an internal combustion engine comprising:

a) a plurality of movably arranged masses comprising at least one first mass and at least one second mass wherein said plurality of movably arranged masses are movable against a resetting force wherein said at least one first mass is coupled to the valve and has a contact surface for an energy transfer between said at least one second mass and said at least one first mass by a mechanical pulse;

b) a stop disposed adjacent to said at least one of said plurality of movably arranged masses wherein said stop stops a movement of said plurality of movably arranged masses; and c) an electromagnet arranged adjacent to said plurality of movably arranged masses, wherein said electromagnet acts on said at least one first mass to retain the valve in an open position.

3. The device for actuating a valve of an internal combustion engine as in claim 2, wherein said plurality of movably arranged masses movable in the same direction.

4. The device for actuating a valve of an internal combustion engine as in claim 2, wherein said at least one first mass is arranged in a linearly displaceable manner, and said at least one second mass can be swivelled and re-swivelled, in a non rotatable manner.

5. The device as in claim 3, further comprising at least one pulse-transmitting member disposed between said two mass components.

6. The device as in claim 2, further comprising a spring coupled to said plurality of masses wherein said resetting force is generated by said spring.

7. The device as in claim 4, further comprising means for retaining at least one of said plurality of masses in a deflected position.

8. The device as in claim 4, further comprising means for influencing an oscillation frequency of said at least one second mass.

9. The device as in claim 5, wherein said at least one pulse transmitting member is an intermediate member coupled to said at least one second mass, wherein said intermediate member transfers a pulse or kinetic energy between said at least one first mass and said at least one second mass during contact between said at least one first mass and said at least one intermediate member.

10. A device for actuating a valve of an internal combustion engine comprising:

a) at least one first mass coupled to the valve;

b) at least one second mass;

c) at least one stop disposed between said at least one first mass and said at least one second mass;

d) at least one first electromagnet disposed adjacent to said at least one first mass;

e) at least one second electromagnet disposed adjacent to said at least one second mass;

f) at least one first spring coupled at one end to said at least one first mass;

g) at least one second spring coupled at one end to said at least one second mass;

h) at least one first support coupled to an end of said at least one first spring opposite said at least one first mass;

i) at least one second support coupled to an end of said at least one second spring opposite said at least one second mass; and j) at least one intermediate member coupled to said at least one second mass;

wherein to open the valve, a current is supplied to said at least one second electromagnet causing said at least one second mass to move against said at least one second spring and away from said at least one first mass and then held in a retaining position, wherein said at least one second electromagnet releases said at least one second mass causing said at least one second mass to move towards said at least one first mass via said at least one second spring wherein said at least one intermediate member contacts said at least one first mass driving said at least one first mass against said at least one first spring and forcing the valve open.

11. The device as in claim 10, wherein said at least one first support is adjustable in relation to a distance from said at least one first mass so that said at least one first spring is initially tensioned to keep the valve closed.

12. The device as in claim 10, wherein said at least one first electromagnet is positioned sufficiently close to said at least one first mass such that when said first electromagnet is charged, said electromagnet exerts a force sufficient to overcome a tension force supplied by said at least one first spring to open the valve or to hold the valve open.

* * * * *